US005547317A

United States Patent [19]

Howell et al.

[11] Patent Number: 5,547,317

[45] Date of Patent: Aug. 20, 1996

[54] MINE SUPPORT SYSTEM

[75] Inventors: Mark Howell; Graham H. Clarke, both of Transvaal, South Africa

[73] Assignee: HL&H Timber Products (Pty) Limited, Braamfontein, South Africa

[21] Appl. No.: 172,421

[22] Filed: Dec. 22, 1993

[30] Foreign Application Priority Data

Dec. 22, 1992 [ZA] South Africa ..... 92/9955

[51] Int. Cl.[6] ..... E21O 15/55

[52] U.S. Cl. ..... 405/288; 248/354.1; 405/259.1; 405/302.1

[58] Field of Search ..... 405/288, 259.1, 405/302.1, 289; 248/354.1–354.7, 356, 351

[56] References Cited

U.S. PATENT DOCUMENTS

| | | | |
|---|---|---|---|
| 1,528,034 | 3/1925 | Thielmann . | |
| 1,946,720 | 2/1934 | Stearns . | |
| 2,190,556 | 2/1940 | Wiebecke et al. . | |
| 3,703,269 | 11/1972 | Meriz . | |
| 4,004,771 | 1/1977 | Plevak et al. | 248/357 |
| 4,091,628 | 5/1978 | Kelley | 405/290 |
| 4,120,164 | 10/1978 | Tomlin | 405/289 |
| 4,349,300 | 9/1982 | Kelley | 405/288 |
| 4,465,405 | 8/1984 | Dürrfeld | 405/289 |
| 4,699,547 | 10/1987 | Seegmilley | 405/288 |
| 4,773,792 | 9/1988 | Landers | 405/230 |
| 5,149,228 | 9/1992 | Pienaar et al. | 405/289 |
| 5,186,430 | 2/1993 | Ellithorpe | 248/354.3 |
| 5,288,178 | 2/1994 | Pienaar | 405/288 |
| 5,292,209 | 3/1994 | Calandra et al. | 405/288 X |

FOREIGN PATENT DOCUMENTS

| | | |
|---|---|---|
| 1027157 | 4/1958 | Germany . |
| 1027158 | 4/1958 | Germany . |
| 1177588 | 9/1964 | Germany . |
| 912947 | 3/1982 | U.S.S.R. . |
| 396454 | 8/1933 | United Kingdom . |

*Primary Examiner*—Dennis L. Taylor
*Attorney, Agent, or Firm*—Morgan & Finnegan, L.L.P.

[57] ABSTRACT

The mine support system (26) is typically used in underground coal mines. Support for the hanging wall (40) of the mine is provided by elongate, transversely extending headboards (10) which are supported by spaced apart supports. The supports may take the form of upright mine supports, typically timber props (28) located on the footwall (34) of the mine working, by roof bolts (30) engaging the hanging wall, or by a combination of props and roof bolts. Prestressing grout bags (32) are located on the headboards and bear against the hanging wall. The combination of headboards and bags forms a continuous bridge between the props.

8 Claims, 2 Drawing Sheets

MINE SUPPORT SYSTEM

BACKGROUND TO THE INVENTION

THIS invention relates to a mine support system.

Various types of elongate props or packs are used in underground mine workings to provide support for the hanging wall. Generally speaking, the supports, and particularly elongate props, have to be located close to one another to provide effective support for the hanging wall. However, placing the supports close to one another can limit access to the working face. This is particularly so in the case of underground coal mines where it may be necessary for large items of machinery to have face access.

SUMMARY OF THE INVENTION

According to the invention there is provided a mine support system in which support for the hanging wall of a mine working is provided by elongate, transversely extending headboards which are supported by spaced apart support means in the form of upright mine supports located on the footwall of the mine working, by roof bolts engaging the hanging wall, or by a combination of such mine supports and roof bolts, and prestressing grout bags which are located on the headboards and which bear against the hanging wall, the combination of headboards and bags forming a continuous bridge between the support means.

The system is typically used to support the hanging wall in an underground coal mine.

In one embodiment of the invention, each headboard comprises parallel, elongate timber members arranged with their timber grain extending longitudinally and end-grain timber blocks located between the elongate timber members, the end-grain timber blocks being located at spaced apart positions to take at least some of the compressive load applied by the support means.

This embodiment may also comprise one or more steel plates enveloping the combination of the elongate timber members and end-grain timber blocks and serving to hold the combination together. Operatively upper and lower surfaces of the combination of the elongate timber members and end-grain timber blocks may also be covered by respective steel plates.

The steel plate which covers the operatively upper surface of the combination can include an end extension which extends beyond the relevant ends of the elongate timber members, the end extension being bent back on itself over an endmost prestressing grout bag.

BRIEF DESCRIPTION OF THE DRAWINGS

The invention will now be described in more detail, by way of example only, with reference to the accompanying drawings in which.

DESCRIPTION OF A PREFERRED EMBODIMENT

Figure 1:
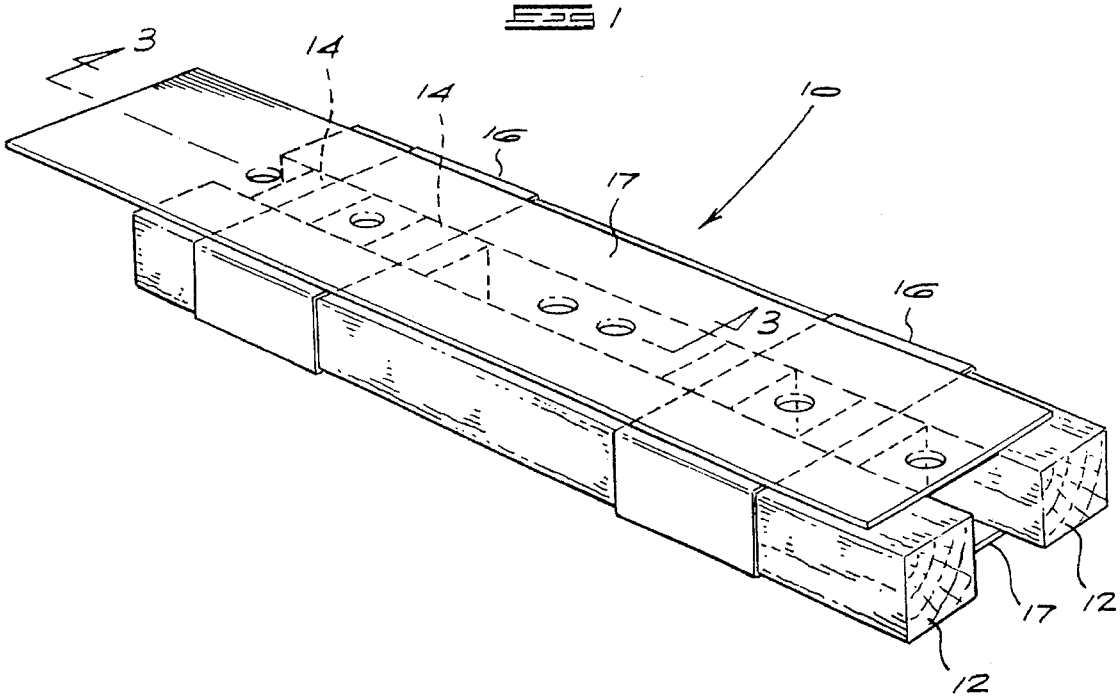
FIG. 1 shows a perspective view of a headboard according to the invention.

FIG. 1 shows a headboard 10 according to the invention. The headboard 10 is of elongate shape and of composite construction.

It consists of both timber and steel components. Two of the major components of the headboard 10 are timber, typically Saligna members 12 which extend for virtually the entire length of the headboard. The timber grain of these members is lengthwise. The members 12 are parallel to one another and are spaced apart by timber, typically Saligna blocks 14 arranged in pairs of adjacent blocks towards opposite ends of the headboard.

An important feature of the illustrated embodiment is the fact that the blocks 14 are end-grain in orientation. By this is meant that the timber grain of the blocks 14 is at right angles to the timber grain of the members 12 and is, in use, vertical.

Thin gauge steel plates 16 are bound about the timber components described so far at lengthwise positions corresponding to the positions of the blocks 14. These plates or bands are fastened in position by means of nails, but any other effective fastening system could equally well be used.

Figure 3:
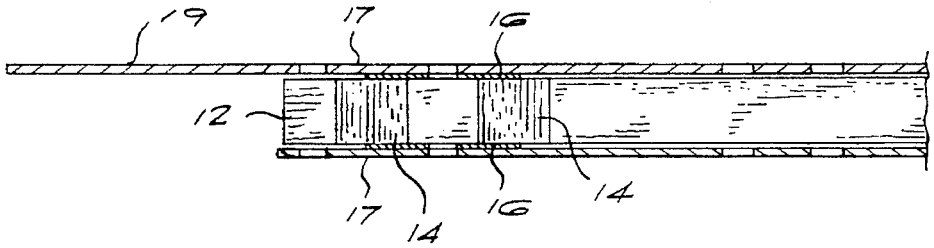
FIG. 3 shows a partial cross-section at the line 3—3 in FIG. 1.

The headboard also includes upper and lower, thin gauge steel plates 17 which are nailed in the illustrated positions. It will be noted that the upper plate 17 extends, at one end, beyond the ends of the timber members 12 as seen at 19 in FIG. 3.

Round holes 18A and 18B are formed through the steel plates between the members 12 and in a central region between the pairs of blocks 14. Further round holes 20A, 20B, 20C and 20D are formed through the upper and lower plates 17 at the positions illustrated in FIG. 2.

Apart from the end extension 19 of the upper plate 17 mentioned above, it will be noted that the headboard and the pattern of holes are symmetrical about the transverse centre line of the headboard.

Figure 4:
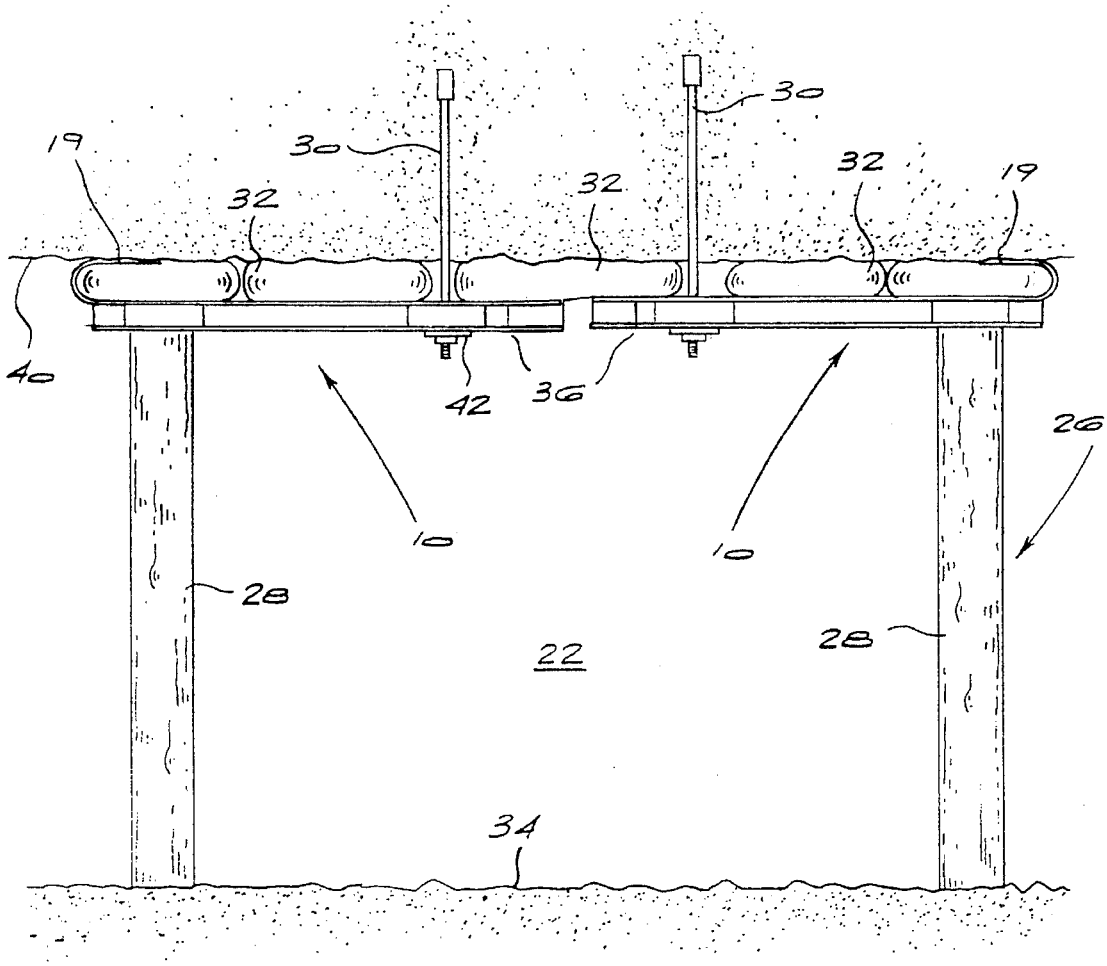
FIG. 4 illustrates a mine support system of the invention in operation in a mine working, looking in a direction towards the working face.

Reference is now made to FIG. 4 which illustrates, in a direction looking towards the mining face, two headboards of the type described above in use in an underground coal mine working 22 in which conventional board-and-pillar mining is taking place. FIG. 4 only shows one mine support system 26 of the invention in the mine working 22 but it will be appreciated that in practice there may be a number of such systems all at different distances from the working face.

The illustrated mine support system 26 consists of two elongate timber props 28, two headboards 10 as described above, two roof bolts 30 and five prestressing grout bags 32. The timber props 28 may merely be so-called stick props, or they may be of more sophisticated design such as PIPESTICKS (trade mark). The roofbolts may be of any conventional design used in coal mine workings to consolidate the hanging wall. The prestressing grout bags are preferably of the fluid impervious type available under the trade mark PROPSETTER.

As illustrated, the props 28 are erected upright on the footwall 34 of the mine working 22 and the headboards 10 are located transversely across the upper ends of the props 28 with their inner ends 36 close to one another. The position at which the upper end of each prop bears against the headboard 10 is illustrated in broken outline in FIG. 2 and it will be noted that this is in the region of the relevant end-grain blocks 14.

Figure 2:
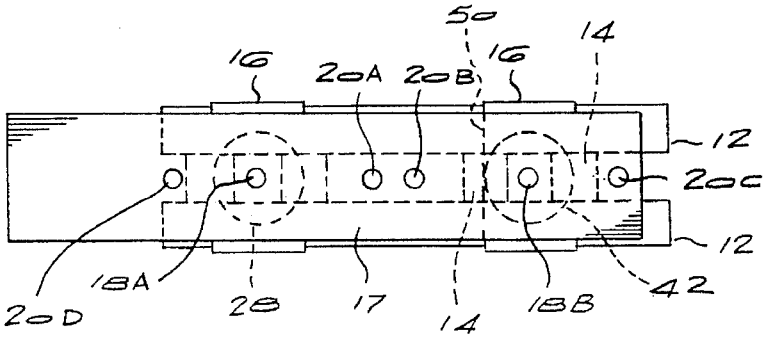
FIG. 2 shows a plan view of the headboard of FIG. 1.

The roof bolts are installed in the conventional manner in predrilled holes in the hanging wall 40. At their lower ends, they engage the headboards 10 via steel plates or washer 42. The position of a typical circular washer 42 is indicated in FIG. 2 in broken outline. Once again, it will be seen that the relevant end-grain blocks 14 are in the bearing area. The roof bolts pass through the holes 18A and 18B in the plates.

Located on top of the headboards 10 are the five prestressing grout bags 32, the bags and headboards in combination defining a continuous bridge between the two props 28. It will be noted that two of the bags are located wholly on their respective headboards, while the central bag bridges between the adjacent ends of the headboards.

It will also be noted that the end extensions 19 of the upper plates 17 are bent over the respective ends of the outermost bags 32. This gives stability to the location of the bags on the headboard and prevents the bags from moving lengthways off the headboards.

The holes 20A to 20D are provided in appropriate positions to receive the filler nozzles of the grout bags 32. In practice, for each bag, the nozzle will be located in the relevant hole in the upper plate 17 and a filler hose will be passed upwardly through the corresponding hole in the lower plate 17 to mate with the filler nozzle. The filler hose extends from a pump, typically a known PACKSETTER grout pump, which serves to pump premixed, fluent grout into the relevant bag 32.

The inflation of the bag with grout brings it into contact with the hanging wall 40 and applies a prestressing force to the support system. The grout is then allowed to set to maintain the prestress force and render the support system immediately capable of taking the vertical loading imposed by the hanging wall 40. The process is repeated for each bag in turn.

The major advantage of the system as described above is the fact that the props 28 are a substantial distance apart. Thus there is a considerable amount of clear space for access to the working face or other parts of the mine working. Added to this, substantial areal coverage of the hanging wall is provided. Still further, the mine support system is installed in a prestressed condition so that it is immediately able to take vertical loading.

The end-grain nature of the blocks 14 is also advantageous. It is well known that timber is less compressible parallel to its grain than across its grain. Thus the end-grain nature of the blocks 14 which are situated at positions where direct vertical loading is applied to the headboard by the props and roofbolts can be expected to increase the compressive resistance of the headboard.

It should however be recognised that the invention is not confined in its scope to the use of end-grain blocks between the elongate members. In other embodiments, the blocks may have their timber grain extending parallel to the grain of the elongate members. As a further alternative, the blocks could be made of a material other than timber. They could, for instance, be made of concrete.

In the illustrated embodiment, the steel components serve both to bind the timber components relative to one another and to reinforce the resulting, composite structure. However it should be appreciated that the invention is not limited to composite arrangements of the illustrated type.

For instance, in some embodiments contemplated by the invention, there are no steel components corresponding to the plates 16 and 17 of the illustrated embodiment. Instead, the timber components are fixed to one another by other suitable fixing means. In one example, the fixing means could be provided by the process known as "spin-drilling". In spin-drilling, a sharpened length of wire is attached to a drilling machine and is drilled through the required assembly of timber components.

When the wire has been drilled right through the timber assembly, its ends are bent over against the outermost timber components. In an arrangement of timber components such as that illustrated in the accompanying drawings, spin-drilled wires would typically extend transversely through the members 12 and blocks 14 as exemplified by the numeral 50 in FIG. 2.

We claim:

1. A mine support system for supporting a hanging wall of a mine working having a hanging wall and a footwall, the mine support system comprising:

a pair of spaced apart, elongate props, each prop having a lower end bearing in use on the footwall and an upper end;

for each prop, an elongate headboard which spans transversely across the upper end of the prop, each headboard having an inner end and an outer end, the inner ends of the headboards being adjacent to one another and being supported by roof bolts engaging the hanging wall, each outer end of the headboard being supported by a prop, and the headboards being aligned with one another; and a plurality of grout bags which are located on the aligned headboards and which are inflatable with grout so as to bear forcibly against the hanging wall, the inflated grout bags and aligned headboards forming a substantially continuous beam in contact with the hanging wall and spanning between the upper ends of the props.

2. A mine support system according to claim 1 wherein each headboard comprises a composite structure with parallel, elongate timber members arranged with their timber grain extending longitudinally and timber blocks located between the elongate timber members, the timber blocks being located at spaced apart positions to take compressive loads applied to the headboards by the roof bolts and props.

3. A mine support system according to claim 2 wherein the timber blocks are end-grain in orientation.

4. A mine support system according to claim 2 wherein the timber blocks have their timber grain extending parallel to the timber grain of the elongate timber members.

5. A mine support system according to claim 2 comprising steel bands enveloping the composite structure in the region of the timber blocks, the bands holding the elongate timber members and timber blocks together.

6. A mine support system according to claim 5 wherein the composite structure has upper and lower surface covered by steel plates.

7. A mine support system according to claim 6 wherein the steel plate which covers the upper surface of the composite structure includes an end extension which extends beyond the elongate timber members, the end extension being bent back on itself over an endmost one of the grout bags.

8. A mine system according to claim 7 wherein the grout bags have filler nozzles and wherein the steel plate covering the lower surface of the composite structure is formed with holes to receive the filler nozzles.

* * * * *